US007250239B2

(12) United States Patent
Nakamura et al.

(10) Patent No.: US 7,250,239 B2
(45) Date of Patent: Jul. 31, 2007

(54) YELLOW TONER FOR FLASH FIXATION, AND ELECTROPHOTOGRAPHIC DEVELOPER AND IMAGE FORMING METHOD USING THE SAME

(75) Inventors: Yasushige Nakamura, Ebina (JP); Satoshi Takezawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 364 days.

(21) Appl. No.: 10/930,867

(22) Filed: Sep. 1, 2004

(65) Prior Publication Data

US 2005/0053857 A1 Mar. 10, 2005

(30) Foreign Application Priority Data

Sep. 9, 2003 (JP) ..... 2003-317089

(51) Int. Cl.
*G03G 9/08* (2006.01)
*G03G 15/20* (2006.01)

(52) U.S. Cl. ..... 430/107.1; 430/108.1; 430/108.23; 430/124

(58) Field of Classification Search ..... 430/108.21, 430/108.23, 108.1, 124, 107.1
See application file for complete search history.

(56) References Cited

U.S. PATENT DOCUMENTS 6,555,280 B2 * 4/2003 Horikoshi et al. ..... 430/108.21
7,083,887 B2 * 8/2006 Nakamura et al. ..... 430/107.1
2003/0190544 A1 * 10/2003 Tanaka et al. ..... 430/108.23
2005/0208397 A1 * 9/2005 Nakamura et al. ..... 430/45

FOREIGN PATENT DOCUMENTS

| | | |
|---|---|---|
| JP | A 61-132959 | 6/1986 |
| JP | A 6-348056 | 12/1994 |
| JP | A 7-191492 | 7/1995 |
| JP | A 10-39535 | 2/1998 |
| JP | A 11-38666 | 2/1999 |
| JP | A 11-65167 | 3/1999 |
| JP | A 11-125928 | 5/1999 |
| JP | A 11-125929 | 5/1999 |
| JP | A 11-125930 | 5/1999 |
| JP | A 2000-35689 | 2/2000 |
| JP | A 2000-147824 | 5/2000 |
| JP | A 2000-155439 | 6/2000 |
| JP | A 2002-156779 | 5/2002 |

* cited by examiner

*Primary Examiner*—John L Goodrow
(74) *Attorney, Agent, or Firm*—Oliff & Berridge, PLC

(57) ABSTRACT

The present invention discloses a yellow toner for flash fixation, comprising an infrared absorbent, one or more yellow colorants, and a binder resin, wherein a* of the infrared absorbent in an CIELAB color space is less than 0, and a* of one or more of the yellow colorants in the CIELAB color space is more than 0, or vice versa; and a developer and an image forming method using the yellow toner.

17 Claims, 3 Drawing Sheets

YELLOW TONER FOR FLASH FIXATION, AND ELECTROPHOTOGRAPHIC DEVELOPER AND IMAGE FORMING METHOD USING THE SAME

CROSS-REFERENCE TO RELATED APPLICATION

This application claims priority under 35 USC 119 from Japanese Patent Application No. 2003-317089, the disclosure of which is incorporated by reference herein.

BACKGROUND OF THE INVENTION

1. Field of the Invention

The present invention relates to a yellow toner for flash fixation used in forming an image in an electrophotographic system, and a developer and an image forming method using the same.

2. Description of the Related Art

In recent years, demand for mass printing has been increasing to print materials such as newspapers and direct mails by electrophotography using electrophotographic toners in the field of high-speed printing. It is known that image printing by electrophotography using flash fixation methods makes far higher printing speeds possible as compared with electrophotographic image printing using thermal fixation methods associated with the use of a heat roll or the like (see, for example, Japanese Patent Application Laid-Open (JP-A) Nos. 60-63545, 60-63546, 60-57858, 60-57857, 58-102248, 58-102247, 60-131544, 60-133460, 61-132959, 2000-147824, 7-191492, 2000-155439, 6-348056, 10-39535, 2000-35689, 11-38666, 11-125930, 11-125928, 11-125929, and 11-65167). This is due to the fact that with flash methods, there is less contact between the members and the recording media. In flash fixation methods, however, when radiating light onto color toner, the efficiency of converting the light to heat is lower than when radiating light onto monochrome toner. It is therefore impossible to use color toners that are used in thermal fixation methods, as they are, in flash fixation methods. Thus, in flash fixation methods, it is known to use toners to which infrared absorbents that have low visible ray wavelength absorption are added.

Examples of compounds known as the infrared absorbents added to such toners include onium compounds (such as aminium derivatives and diimmonium derivatives), cyanine compounds, nickel complex compounds, phthalocyanine compounds, and ytterbium oxide compounds. Usually, the infrared absorbent is added to the inside of the toner, however, a technique of adhering the infrared absorbent to the outside of the toner is also known (see JP-A No. 2002-156779).

In the case of color toners for thermal fixation methods using no infrared absorbent, for example, benzimidazolone (C. I. Pigment Yellow 180 or the like), naphthol carmine F6B (C. I. Pigment Red 184 or the like) and β copper phthalocyanine (C. I. Pigment Blue 15:3 or the like) are respectively used as pigments for yellow toners, pigments for magenta toners and pigments for cyan toners (see JP-A No. 2000-199982).

Isoindoline compounds (C. I. Pigment Yellow 185 or the like), monoazo litolrubin and β copper phthalocyanine (C. I. Pigment Blue 15:3 or the like) are also respectively used as pigments for yellow toners, pigments for magenta toners and pigments for cyan toners (see JP-A No. 9-166889).

However, all infrared absorbents have color since infrared absorbents slightly absorb light having visible ray wavelengths. Therefore, when a toner to which an infrared absorbent is added is used to form a full color image with a flash fixation method, problems occur. Specifically, when the same pigment as used in thermal fixation toners is used as a colorant added to the above-mentioned toner, all of the color is shifted by the effect of the color of the added infrared absorbent. Even if the toner having shifted color(s) is used and the color of the formed image is adjusted by means of an image forming device, sufficient color reproducibility cannot be obtained. Therefore, for example, in yellow toners to which an infrared absorbent colored into green, such as a naphthalocyanine compound or an onium compound, is added, the color thereof is shifted toward a green color.

Therefore, in order to obtain a yellow toner for flash fixation excellent in color reproducibility for full color or business color usage, it is necessary to correct color shift resulting from the added infrared absorbent.

Accordingly, there is a need for a yellow toner for flash fixation wherein color shift resulting from an infrared absorbent is corrected to exhibit superior color reproducibility, and an electrographic developer and an image forming method using the yellow toner.

SUMMARY OF THE INVENTION

The inventors of the invention have made eager investigations to meet the above-mentioned demand. As a result, they have found out that in order to correct color shit resulting from an infrared absorbent, it is effective to use a yellow colorant for shifting the color of a yellow toner to the color opposite to that of the infrared absorbent.

A first aspect of the invention provides a yellow toner for flash fixation, comprising an infrared absorbent, one or more yellow colorants, and a binder resin, wherein a* of the infrared absorbent in a CIELAB color space is less than 0, and a* of one or more of the yellow colorants in the CIELAB color space is more than 0.

A second aspect of the invention provides an electrophotographic developer, comprising a yellow toner for flash fixation comprising an infrared absorbent, one or more yellow colorants, and a binder resin, wherein a* of the infrared absorbent in a CIELAB color space is less than 0, and a* of one or more of the yellow colorants in the CIELAB color space is more than 0.

A third aspect of the invention is provides an image forming method comprising: forming an electrostatic latent image on a surface of a latent image holding member, developing the electrostatic latent image formed on the surface of the latent image holding member with a developer comprising a yellow toner for flash fixation comprising an infrared absorbent, one or more yellow colorants, and a binder resin to form a toner image, transferring the toner image formed on the surface of the latent image holding member onto a surface of an image recording medium, and flash fixing the toner image onto the surface of the recording medium to form an image, wherein a* of the infrared absorbent in a CIELAB color space is less than 0, and a* of one or more of the yellow colorants in the CIELAB color space is more than 0.

A fourth aspect of the invention provides a yellow toner for flash fixation, comprising an infrared absorbent, one or more yellow colorants, and a binder resin, wherein a* of the infrared absorbent in a CIELAB color space is more than 0, and a* of one or more of the yellow colorants in the CIELAB color space is less than 0.

A fifth aspect of the invention provides an electrophotographic developer, comprising a yellow toner for flash fixation comprising an infrared absorbent, one or more yellow colorants, and a binder resin, wherein a* of the infrared absorbent in a CIELAB color space is more than 0, and a* of one or more of the yellow colorants in the CIELAB color space is less than 0.

A sixth aspect of the invention provides an image forming method comprising: forming an electrostatic latent image on a surface of a latent image holding member, developing the electrostatic latent image formed on the surface of the latent image holding member with a developer comprising a yellow toner for flash fixation comprising an infrared absorbent, one or more yellow colorants, and a binder resin to form a toner image, transferring the toner image formed on the surface of the latent image holding member onto a surface of an image recording medium, and flash fixing the toner image onto the surface of the recording medium to form an image, wherein a* of the infrared absorbent in a CIELAB color space is more than 0, and a* of one or more of the yellow colorants in the CIELAB color space is less than 0.

As described above, according to the invention, it is possible to provide a yellow toner for flash fixation wherein color shift resulting from an infrared absorbent is corrected to exhibit superior color reproducibility, and an electrographic developer and an image forming method using the yellow toner.

BRIEF DESCRIPTION OF THE DRAWINGS

Preferred embodiments of the invention will be described in detail based on the following figures, wherein.

DETAILED DESCRIPTION OF THE INVENTION

Yellow Toner for Flash Fixation

Figure 1:
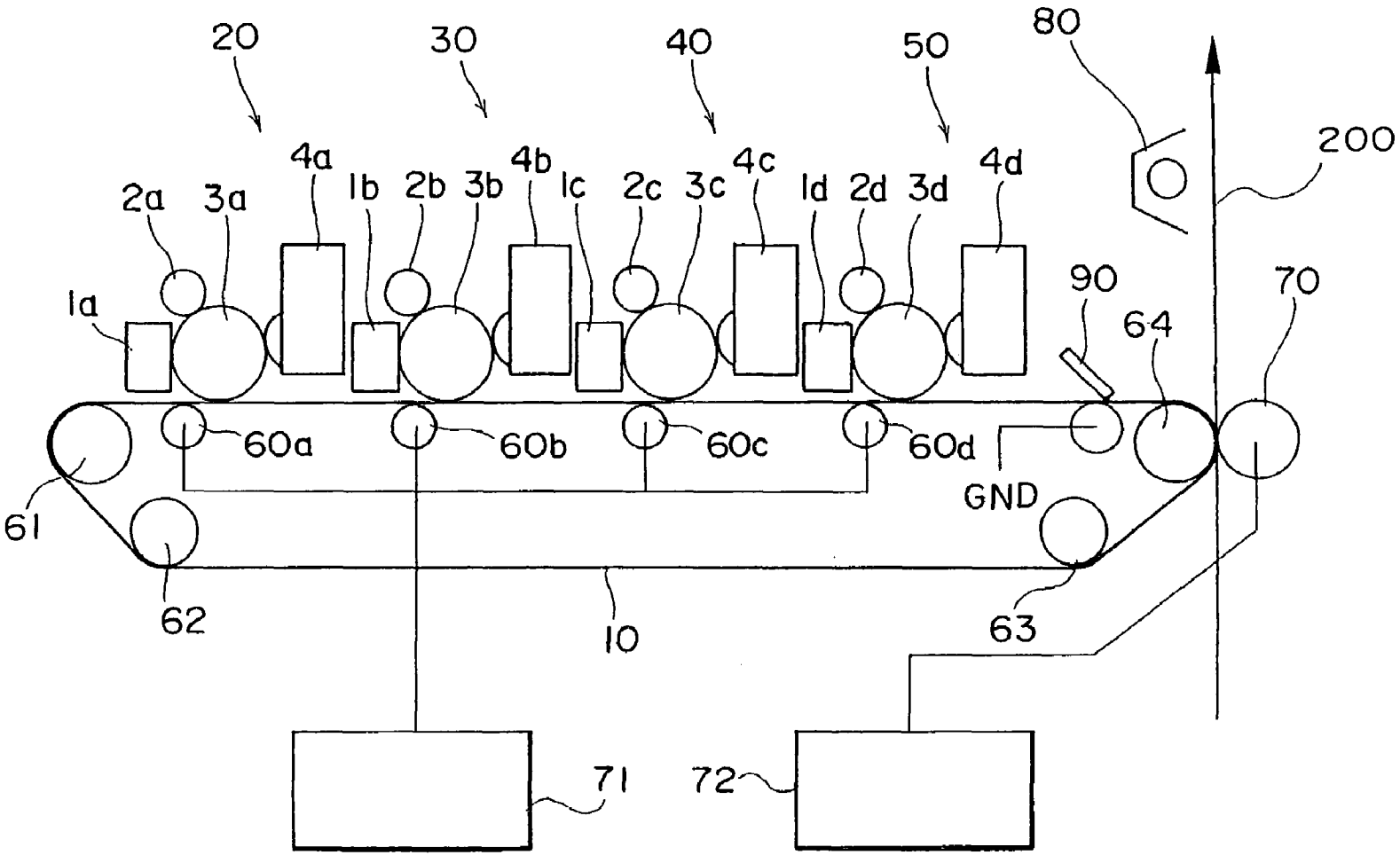
FIG. 1 is a view which schematically illustrates an example of an image forming device used in the image forming method of the invention.

The yellow toner for flash fixation (hereinafter referred to as the "yellow toner" as the case may be) of the invention includes an infrared absorbent, one or more yellow colorants, and a binder resin.

When a* of the infrared absorbent included in the yellow toner in the CIELAB color space is less than 0 (that is, in the case of an infrared absorbent which, as the added amount thereof increases, gradually colors the yellow toner a greenish color), the yellow toner of the invention includes one or more yellow colorants, a* of which in the CIELAB color space is more than 0 (that is, one or more reddish yellow colorants). The CIELAB color space is the color space defined in JIS Z 8729, which is incorporated by reference herein.

When a* of the infrared absorbent included in the yellow toner in the CIELAB color space is more than 0 (that is, in the case of an infrared absorbent which, as the added amount thereof increases, gradually colors the yellow toner a reddish color), the yellow toner of the invention includes one or more yellow colorants, a* of which in the CIELAB color space is less than 0 (that is, one or more greenish yellow colorants).

In short, the yellow toner of the invention has good color reproducibility since one or more yellow colorants, the color (i.e., a* value) of which cancels coloration caused by the included infrared absorbent, are contained in the yellow toner, thereby correcting color shift resulting from the infrared absorbent.

The yellow toner of the invention may contain a combination of two or more yellow colorants. In this case, L*, a* and b* of each of the yellow colorants, the added amount thereof and the ratio thereof are selected such that the color shift resulting from the infrared absorbent can be corrected and that sufficient brightness and yellowness can be obtained.

When the yellow toner includes an infrared absorbent, a* of which is less than 0, the yellow toner can include not only a yellow colorant, a* of which is more than 0, but also a yellow colorant, a* of which is less than 0.

Similarly, when the yellow toner includes an infrared absorbent, a* of which is more than 0, the yellow toner can include not only a yellow colorant, a* of which is less than 0, but also a yellow colorant, a* of which is more than 0.

It is practical from the viewpoint of availability of the yellow colorant(s) to use commercially available products, the L*, a* and b* values of which are known as the yellow colorant(s). When only one yellow colorant is used, it may be difficult to satisfactorily balance correction of color shift resulting from the infrared absorbent, and brightness and yellowness of the toner (that is, L*, a* and b* of yellow images made of the yellow toner). To the contrary, when two or more yellow colorants are used as described above, it is possible to satisfactorily balance correction of color shift resulting from the infrared absorbent, brightness and yellowness.

In the yellow toner of the invention, a combination of two or more yellow colorants may be used as described above. Practically, use of a combination of only two yellow colorants (or agents classified into two classes in accordance with some standard, for example, L*, a* or b* value) makes it possible to satisfactorily balance correction of color shift resulting from the infrared absorbent, and brightness and yellowness of the toner.

When the yellow toner includes an infrared absorbent, a* of which is less than 0, in this case, it is preferable that the yellow toner includes a combination of a first yellow colorant, a* of which is 5 or more, and a second yellow colorant, a* of which is within the range of 0 to −10. On the other hand, when the yellow toner includes an infrared absorbent, a* of which is more than 0, it is preferable that the yellow toner includes a combination of a first yellow colorant, a* of which is −5 or less, and a second yellow colorant, a* of which is within the range of 0 to 10. In both cases, two or more first yellow colorants may be used. Moreover, two or more second yellow colorants may be used.

Preferable specific examples of combination of commercially available products (yellow pigments) are as follows:

When the yellow toner includes an infrared absorbent, a* of which is less than 0, it is preferable that the yellow toner contains a combination of one or more yellow colorants selected from the following group A and one or more yellow colorants selected from the following group B:

<Group A>: C. I. Pigment Yellow 180, C. I. Pigment Yellow 185, C. I. Pigment Yellow 74, and C. I. Pigment Yellow 93 (C. I. Pigment Yellow 180 and C. I. Pigment Yellow 93 are more preferable since these pigments exhibit negativity in the AMES test and have high safety regarding skin sensitizing potential and is inexpensive); and <Group B>: C. I. Pigment Yellow 139, C. I. Pigment Yellow 110, C. I. Pigment Yellow 95, C. I. Pigment Yellow 123, C. I. Pigment Yellow 166 and C. I. Pigment Yellow 193 (C. I. Pigment Yellow 139 is more preferable since the pigment exhibits negativity in the AMES test and has high safety regarding skin sensitizing potential, and is halogen-free and inexpensive).

Commercially available products of the exemplified yellow pigments are, for example, Toner Yellow HG (manufactured by Clariant Co.) as the C. I. Pigment Yellow 180, Paliotol Yellow D1155 (manufactured by BASF Co.) as the C. I. Pigment Yellow 185, Hansa Brilliant Yellow 2GX70N (manufactured by Clariant Co.) as the C. I. Pigment yellow 74, Novoperm Yellow P-M3R (manufactured by Clariant Co.) as the C. I. Pigment Yellow 139, and Cromophtal yellow 2RLP (manufactured by Ciba Geigy Co.) as the C. I. Pigment Yellow 110.

The yellow colorants classified into the group A are often used in yellow toners that can be thermally fixed, and used to enhance the degree of development of yellow color. The yellow colorants classified into the group B are slightly reddish yellow colorants, a* of which is more than 0, in order to cancel color shift (toward a green color) caused by the infrared absorbent.

In such a combination, the weight ratio (IRg/YB) of the amount (IRg) of the infrared absorbent to the amount (YB) of the color colorant(s) selected from the group B is preferably within the range of 0.1 to 4, and more preferably within the range of 0.6 to 2.

If the ratio of IRg/YB is more than 4, color shift caused by the infrared absorbent cannot be cancelled by the yellow colorant(s) selected from the group B. As a result, yellow images made of such a yellow toner become greenish so that the images look yellowish green, whereby deteriorated color reproducibility may be obtained. On the other hand, if the ratio of IRg/YB is less than 0.1, the effect in which the yellow colorant(s) selected from the group B can cancel color shift becomes too strong. As a result, yellow images made of such a yellow toner become reddish so that the images look orange, whereby deteriorated color reproducibility may be obtained.

When the yellow toner includes a red-colored infrared absorbent, a* of which is more than 0, it is preferable that the yellow toner includes a combination of one or more yellow colorants selected from the following group A' and one or more yellow colorants selected from the following group B':

<Group A'>: C. I. Pigment Yellow 95, C. I. Pigment Yellow 123, C. I. Pigment Yellow 166, and C. I. Pigment Yellow 193; and <Group B'>: C. I. Pigment Yellow 93, C. I. Pigment Yellow 138 and C. I. Pigment Yellow 167.

The yellow colorants classified into the group A' are used to enhance the degree of development of yellow color. The yellow colorants classified into the group B' are slightly greenish yellow colorants, a* of which is less than 0, in order to cancel color shift (toward a red color) caused by the infrared absorbent.

In such a combination, the weight ratio (IRr/YB') of the amount IRr of the infrared absorbent to the amount YB' of the color colorant(s) selected from the group B' is preferably within the range of 0.1 to 4, and more preferably within the range of 0.6 to 2.

If the ratio of IRr/YB' is more than 4, color shift caused by the infrared absorbent cannot be cancelled by the yellow colorant(s) selected from the group B'. As a result, yellow images made of such a yellow toner become reddish so that the images look orange, whereby deteriorated color reproducibility may be obtained. On the other hand, if the ratio of IRr/YB' is less than 0.1, the effect in which the yellow colorant(s) selected from the group B' can cancel color shift becomes too strong. As a result, yellow images made of such a yellow toner become greenish so that the images look yellowish green, whereby deteriorated color reproducibility may be obtained.

As for the color gamut of a yellow solid image formed on the surface of a recording medium such as paper by electrophotography using only the yellow toner of the invention described above, L*, a* and b* of the image are preferably 70 or more, from −15 to 5, and 70 or more, respectively, when the amount of the yellow toner adhering to the image portion of the medium is set to 0.5 mg/cm$^2$ or more. a* is more preferably within the range of −12 to 3. By setting the color gamut of the toner to this range, a yellow image which has excellent color reproducibility and high brightness can be formed on the recording medium. The upper limit of each of L* and b* is not particularly limited, but is 100 from the viewpoint of practical use.

The following describes raw materials of the yellow toner of the invention, and a process for producing the toner in more detail.

-Colorant (Yellow Colorant)-

As the yellow colorant of the yellow toner of the invention, the yellow pigments exemplified above are particularly preferable. However, the yellow colorants that can be used in the invention are not limited thereto. Any known coloring material that exhibits yellow color can be used in the invention.

Besides the above-mentioned yellow pigments, for example, the following yellow pigments can be used: C. I. Pigment Yellow 1, C. I. Pigment Yellow 2, C. I. Pigment Yellow 3, C. I. Pigment Yellow 12, C. I. Pigment Yellow 13, C. I. Pigment Yellow 14, C. I. Pigment Yellow 16, C. I. Pigment Yellow 17, C. I. Pigment Yellow 55, C. I. Pigment Yellow 73, C. I. Pigment Yellow 75, C. I. Pigment Yellow 83, C. I. Pigment Yellow 97, C. I. Pigment Yellow 98, C. I. Pigment Yellow 114, C. I. Pigment Yellow 128, C. I. Pigment Yellow 129, C. I. Pigment Yellow 150, C. I. Pigment Yellow 151, and C. I. Pigment Yellow 154.

The color of the yellow colorant is not particularly limited so long as the color looks yellow when viewed by naked eyes. From the viewpoint of brightness, L* is preferably from 40 to 100, and more preferably from 60 to 80. From the viewpoint of the degree of development of yellow color, b* is preferably from 40 to 100, and more preferably from 50 to 90.

a*, which is related to the balance between reddish tinge and greenish tinge, is preferably from −40 to 40, and more preferably from −20 to 20. When two color colorants (classified into different classes) are combined with each other, a* can be set to a value within the above-mentioned range.

The content (or the total ratio) of the yellow colorant(s) in the yellow toner of the invention is not particularly limited, and is preferably from 0.1 to 20% by weight, and more preferably from 0.5 to 15% by weight.

The yellow toner of the invention is usually used together with other toners such as a cyan toner and a magenta toner when an image is formed. Colorants used in the cyan toner and the magenta toner may be known pigments.

For reference, examples of magenta pigments include C. I. Pigment Red 5 (Symuler Fast Red 4188N, manufactured by Dainippon Ink & Chemicals, Inc.), C. I. Pigment red 22 (Seikafast Scarlet G, manufactured by Dainichiseika Color & Chemicals Mfg. Co., Ltd., and Symuler Fast Scarlet BG, manufactured by Dainippon Ink & Chemicals, Inc.), C. I. Pigment Red 48:1 (Linol Red 2B FG-3303-G, Toyo Ink Mfg. Co., Ltd., and Symuler Red 3109, manufactured by Dainippon Ink & Chemicals, Inc.), C. I. Pigment Red 57:1 (Linol Red 6B FG-4215, manufactured by Toyo Ink Mfg. Co., Ltd., Symuler Brilliant Carmine 6B273, manufactured by Dainippon Ink & Chemicals, Inc., and PV Rubine L6B, manufactured by Clariant Co.), C. I. Pigment Red 112 (Oriental Fast Red GR, manufactured by Toyo Ink Mfg. Co., Ltd.), C. I. Pigment Red 114 (Pollux Pink PM-2B, manufactured by Sumika Color Co.), C. I. Pigment Red 122 (Hostaperm Pink E 02, manufactured by Clariant Co., and Fastogen Super Magenta R, manufactured by Dainippon Ink & Chemicals, Inc.), C. I. Pigment Red 166 (Fastogen Super Red R, manufactured by Dainippon Ink & Chemicals, Inc.), C. I. Pigment Red 184 (Permanent Rubin F6B, manufactured by Clariant Co.), C. I. Pigment Violet 19 (Hostaperm Red E2B70, manufactured by Clariant Co., and Hostaperm Red Violet ER02, manufactured by Clariant Co.).

Examples of cyan pigments include C. I. Pigment Blue 15 (IRGALITE BLUE BLPO, manufactured by Ciba Geigy Co.), C. I. Pigment Blue 15:3 (Chromo fine Blue 4920, manufactured by Dainichiseika Color & Chemicals Mfg. Co., Ltd., Fastogen Blue FGF, manufactured by Dainippon Ink & Chemicals, Inc., and Linol Blue FG-7351, manufactured by Toyo Ink Mfg. Co., Ltd.), C. I. Pigment Blue 16 (Heliogen Blue 16, manufactured by BASF Co.), C. I. Pigment Green 7 (Phthalocyanine Green, manufactured by Toyo Ink mfg. Co., Ltd.) and C. I. Pigment Green 36 (Cyanine Green 2 YL, manufactured by Toyo Ink Mfg. Co., Ltd.).

-Infrared Absorbent-

The yellow toner of the invention includes an infrared absorbent which has at least one intense light absorption peak within the near infrared wavelength range of 750 to 2000 nm (when the absorption spectrum of the infrared absorbent is measured with a spectrophotometer).

The infrared absorbent may be a known inorganic or organic material. Specifically, the following materials can be used as such.

As the infrared absorbent, a* of which in the CIELAB color space is less than 0, an onium compound (an aminium derivative or a diimmonium derivative), a cyanine compound, a phthalocyanine compound, or an ytterbium compound can be used.

Among these infrared absorbents, an onium compound (an aminium derivative or a diimmonium derivative) and a phthalocyanine derivative are particularly preferable since they have high infrared absorption efficiency in flash fixation methods such as a flash fixation method and improve fixability of the toner. Use of a combination of a phthalocyanine derivative with an onium compound (an aminium derivative or a diimmonium derivative) is more preferable since these compounds are complementary to each other so as to minimize coloration and they have good fixability.

As commercially available products of the infrared absorbents, the following can be used: for example, YKR-5010™ (manufactured by Yamamoto Chemicals, Inc.) as the phthalocyanine compound, and AM 1™ (manufactured by Teikoku Chemical Industries Co., Ltd.) and IRG003™ (Nippon Kayaku Co., Ltd.) as the onium compound.

As the infrared absorbent, a* of which in the CIELAB color space is more than 0, a nickel complex compound, and/or a polyazo compound can be used.

As commercially available products of the infrared absorbents, the following can be used: for example, SIR 130™ (manufactured by Mitsui Chemicals, Inc.) as the nickel complex compound and NIA 770H ™ (manufactured by Hakkol Chemical Co.) as the polyazo compound.

The content by percentage (or the total ratio) of the infrared absorbent in the yellow toner is not particularly limited, and is preferably from 0.01 to 15% by weight, more preferably from 0.1 to 5% by weight, and even more preferably from 0.25 to 1% by weight. If the content of the infrared absorbent is less than 0.01% by weight, the yellow toner cannot sufficiently absorb infrared rays when the toner is flash fixed. As a result, fixation failure may occur. If the content of the infrared absorbent is more than 15% by weight, the coloring effect of the infrared absorbent becomes remarkable. As a result, it may be difficult for the yellow colorant(s), which is contained in the yellow toner so as to correct color shift resulting from the infrared absorbent, to cancel the shift.

The surface of the infrared absorbent used in the invention may be treated with a coupling agent or the like. In this case, it is preferable to conduct the treatment, using 0.01 to 20 parts by weight, preferably 0.05 to 10 parts by weight, and more preferably 0.1 to 5 parts by weight of the coupling agent for 100 parts by weight of the infrared absorbent.

-Binder Resin-

The binder resin used in the yellow toner of the invention is not particularly limited, and may be a known resin. Examples thereof include a polyester resin, a styrene-acrylic resin, an epoxy resin, a polyether polyol resin, and a polylactic acid resin. A polyester resin is particularly preferable.

The yellow toner of the invention is used in flash fixation methods such as a flash fixation method. Therefore, unlike binder resins in toners used in thermal fixation methods using a heating roll, the number-average molecular weight Mn of the binder resin used in the yellow toner of the invention can be selected from the viewpoint of the sharp meltability thereof without considering offset resistance. Specifically, the number-average molecular weight Mn is preferably from 1000 to 2500, and more preferably from 1200 to 1500. If the number-average molecular weight Mn is less than 1000, such a binder resin sublimates and then causes a deodorizing filter to clog at the time of flash fixation. If the number-average molecular weight Mn is more than 2500, fixability of the toner may deteriorate.

-Other Components-

Components (such as wax, fine particles and an antistatic agent) other than the infrared absorbent, the yellow colorant(s) and the binder may be internally or externally added to the yellow toner of the invention, if necessary.

The wax may be, for example, a known ordinary wax such as polyethylene, polypropylene, ester wax, carnauba wax, Fischer Tropisch wax, paraffin wax, rice wax, polyester wax, or polyglycerin wax.

White inorganic fine particles as a fluidity improver may be incorporated into the yellow toner of the invention. The ratio thereof in the yellow toner is preferably from 0.01 to 5% by weight, and more preferably from 0.01 to 2.0% by weight. Examples of the material of the inorganic fine particles include silica, alumina, titanium oxide, barium titanate, magnesium titanate, calcium titanate, strontium titanate, zinc oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. Among these materials, silica is particularly preferable. A known material such as titanium, resin fine powder or alumina may be used together with silica. A cleaning activator may be included in the yellow toner. Examples of the activator include metal salts of higher aliphatic acids, a typical example of which is zinc stearate, and fine particles made of fluorine-containing polymers.

The antistatic agent may be, for example, a known one such as calixarene, a nigrosin dye, a quaternary ammonium salt, an amino group-containing polymer, a metal-containing azo dye, a complex compound of salicylic acid, a phenolic compound, an azo chromium compound, or an azo zinc compound. In order to give magnetism to the yellow toner, a magnetic material such as iron powder, magnetite or ferrite may be contained in the toner.

-Production Process-

The following describes a process for producing the yellow toner of the invention. The yellow toner of the invention can be produced in the same manner as known processes for producing a toner, such as a pulverization process and a polymerization process.

When the pulverization process is used, the toner of the invention can be produced, for example, as follows. First, the yellow colorant(s), the infrared absorbent, the binder resin and optional components (for example, the wax or the antistatic agent) are mixed, and the mixture is melted and kneaded by using a kneader, or an extruder. Thereafter, the resultant kneaded product is roughly pulverized and then pulverized into fine particles with a jet mill. The fine particles are classified with a wind power classifier to obtain toner particles having a desired particle size. If necessary, an external additive is added to the toner particles to yield the yellow toner of the invention.

When the polymerization process is used, suspension polymerization or emulsion polymerization can be chiefly used.

When suspension polymerization is used to produce the yellow toner of the invention, the toner can be produced, for example, as follows. First, a monomer such as styrene, butyl acrylate, or 2-ethylhexyl acrylate, a crosslinking agent such as divinylbenzene, a chain transfer agent such as dodecylmercaptan, and a polymerization initiator are added to the yellow colorant(s) and the infrared absorbent. If necessary, the antistatic agent and the wax are also added thereto to produce a monomer composition.

Thereafter, the monomer composition is added to a water phase which contains a suspension stabilizer such as calcium triphosphate or polyvinyl alcohol, and/or a surfactant. An emulsion is produced from the resultant by using a rotor stator type emulsifier, a high-pressure type emulsifier, or an ultrasonic type emulsifier. The emulsion is then heated to polymerize the monomer, thereby yielding particles. After the end of the polymerization, the resultant particles are washed and dried. If necessary, an external additive is added thereto. In this way, the yellow toner of the invention can be obtained.

When suspension polymerization is used to produce the yellow toner of the invention, the toner can be produced, for example, as follows. First, a monomer such as styrene, butyl acrylate, or 2-ethylhexyl acrylate is added into a solution in which a water-soluble polymerization initiator such as potassium persulfate is dissolved in water. If necessary, a surfactant such as sodium dodecylsulfate is also added to the solution. While the resultant is being stirred, the resultant solution is heated to polymerize the monomer, thereby yielding resin particles.

Thereafter, the yellow colorant(s) and the infrared absorbent are added to the resultant suspension in which the resin particles are dispersed. If necessary, powder of the antistatic agent and/or the wax is also added to the suspension. The pH and temperature of the suspension, and intensity of the stirring are adjusted to hetero-aggregate the yellow colorant powder, the infrared absorbent powder and the other components, thereby yielding hetero-aggregates. Furthermore, the reaction system is heated to a temperature of not less than the glass transition temperature of the resin particles so as to coalesce the hetero-aggregates, thereby yielding toner particles. Thereafter, the toner particles are washed and dried. If necessary, an external additive is added thereto. In this way, the yellow toner of the invention can be obtained.

Electrophotographic Developer

The following describes the electrophotographic developer (hereinafter referred to as the "developer" as the case may be) of the invention. The developer of the invention may be a one component-developer made of only the yellow toner of the invention, or a two-component developer made of a carrier and the yellow toner of the invention. Hereinafter, the developer of the invention that is a two-component developer is described in detail.

The carrier which can be -used in the two-component developer is not particularly limited, and may be a known carrier. The carrier is, for example, a resin-coated carrier, which has a resin coating layer on the surface of a core material, or a resin dispersion type carrier, wherein an electroconductive material is dispersed in a matrix resin.

Examples of the coating resin or the matrix resin used in the carrier include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicone resins having organo siloxane bonds and modified products thereof, fluorine-containing resins, polyester, polycarbonate, phenol resins, and epoxy resins. However, the coating resin or the matrix resin is not limited to these examples.

Examples of the electroconductive material include metals such as gold, silver and copper, carbon black, titanium oxide, zinc oxide, barium sulfate, aluminum borate, potassium titanate, and tin oxide. However, the electroconductive material is not limited to these examples.

Examples of the core material of the carrier include magnetic metals such as iron, nickel and cobalt, magnetic oxides such as ferrite and magnetite, and glass beads. In order to use the carrier in a magnetic brush process, it is preferable to use a magnetic material as the core material. The volume mean diameter of core particles of the carrier is generally from 10 to 500 μm, and preferably from 30 to 100 μm.

The method for coating the surface of the core material of the carrier with the resin may be a method of coating the surface with the above-mentioned resin itself, or a coating layer-forming solution in which the coating resin and optional additives are dissolved in a suitable solvent. The solvent is not particularly limited, and may be appropriately selected, considering the used coating resin, applicability thereof, and other factors.

Specific examples of the resin-coating method include an immersing method of immersing the core material of the carrier in the coating layer-forming solution, a spay method of spraying the coating layer-forming solution onto the surface of the core material of the carrier, a fluid bed method of spraying the coating layer-forming solution onto the core material of the carrier which is being floated by flowing-air, and a kneader coater method of mixing the core material of the carrier with the coating layer-forming solution with a kneader coater and then removing the solvent therein.

The blend ratio (by weight) of the electrographic toner of the invention to the carrier in the two-component developer is preferably from about 1:100 to 30:100, and preferably from about 3:100 to 20:100.

When a carrier having a resistance value of $10^8$ to $10^{15}\Omega$ is used, the toner of the invention is preferably used in the developer such that a toner concentration is within the range of 3 to 15% by weight. The resistance value of the developer adjusted in this way is preferably $10^{10}$ Ω or more. Adjustment of the resistance value of the carrier, the toner concentration and the resistance value of the developer to such ranges makes it possible to keep a good charging quantity.

Image Forming Method

The following describes the image forming method of the invention. This method is any image forming method so long as the yellow toner of the invention (or a developer including the toner) is used in the method. Specifically, the image forming method preferably includes: forming an electrostatic latent image on the surface of a latent image holding member; developing the latent image with a developer to form a toner image; transferring the toner image onto the surface of a recording medium; and flash fixing the toner image on the recording medium to form an image. In this case, a developer including the yellow toner of the invention is indispensably used as the developer. In order to form a full color image, the developer including the yellow toner of the invention is combined with other developers which include toners having other colors such as cyan, magenta, and black.

Each of the above-described steps can be performed by a known method which is adopted in conventional image forming methods. As for flash fixation, known flash fixation methods such as a flash fixation method or infrared-radiating fixation methods can be used. The image forming method of the invention may include a step other than the above-mentioned steps, for example, a cleaning step of cleaning the surface of the latent image holding member. Moreover, before the toner image is transferred to the recording medium, the toner image can be transferred to an intermediate transfer member.

When an electrophotographic photoreceptor is used as the latent image holding member, formation of an image according to the image forming method of the invention can be performed, for example, as follows. First, the surface of the electrophotographic photoreceptor is uniformly charged with a charging unit such as a corotron charging unit, or a contact charging unit. Thereafter, the photoreceptor is imagewise exposed to light to form an electrostatic latent image thereon. Next, the photoreceptor is brought into contact with or disposed close to a developing roll on which a developer layer is formed so as to adhere toner particles contained in the developer layer to the electrostatic latent image, thereby forming a toner image on the electrophotographic photoreceptor. A corotron charging unit or the like is used to transfer the formed toner image onto the surface of a recording medium. The toner image transferred on the recording medium is flash fixed with an flash fixing device to form an image on the recording medium.

The photoreceptor is generally an inorganic photoreceptor made of amorphous silicon, or selenium, or an organic photoreceptor made of polysilane, or phthalopolymethine. An amorphous silicon photoreceptor is particularly preferable since it has a long life.

When four color toners, which are a cyan toner and a magenta toner for flash fixation each including an infrared absorbent, a black toner for flash fixation, and the yellow toner of the invention, are used in such image formation, flash fixation may be performed every time when each color toner image is transferred to the recording medium, or may be performed once after a full color image made of the four color images has been transferred to the recording medium.

When the four color toner images are separately transferred and separately flash fixed (the fixation may be referred to as "single color flash fixation" hereinafter), flash energy at the time of the flash fixation (hereinafter referred to as "flash energy" as the case may be) is preferably within the range of about 1 to 3 J/cm$^2$. When a full color image is transferred and flash fixed (the fixation may be referred to as "four-color batch flash fixation" hereinafter), flash energy is preferably within the range of about 2 to 7 J/cm$^2$.

If the flash energy is less than 1 J/cm$^2$ in the single color flash fixation or is less than 2 J/cm$^2$ in the four-color batch flash fixation, satisfactory fixation may be not attained. On the other hand, if the flash energy is more than 3 J/cm$^2$ in the single color flash fixation or is more than 7 J/cm$^2$ in the four-color batch flash fixation, toner voids, burnt deposits or other defects may occur.

An flash fixing device used for the flash fixation may be a light source (lamp) which can radiate infrared rays having a near infrared ray wavelength. Examples thereof include a mercury lamp, a halogen lamp, and a xenon lamp. These lamps may be used alone or a combination of two or more thereof may be used.

The light source is preferably a xenon lamp since the lamp more effectively improves light absorption efficiency of the infrared absorbent used in the invention in the near infrared wavelengths to enhance fixability of the toner.

For reference, the emission energy per unit area of one flash from a xenon lamp or xenon lamps, which represents intensity of the xenon lamp(s), is represented by the following equation (3).

$$S=((1/2)\times C\times V^2)/(u\times 1)/(n\times f) \quad (3)$$

In the formula, n represents the number of the lamps, f represents the flashing frequency (Hz), V represents the inputted voltage (V), C represents the condenser capacity (μF), u represents the process conveyance speed (mm/s), 1 represents the printing width (mm), and S represents the energy density (J/cm$^2$).

The following describes an example of the image forming device used in the image forming method of the invention, referring to the attached drawing.

FIG. 1 is a schematic view illustrating this example. In FIG. 1, reference numbers 1*a* to 1*d* represent charging units; 2*a* to 2*d* represent light-exposing units; 3*a* to 3*d* represent latent image holding members (photoreceptors); 4*a* to 4*d* represent developing units; 10 represents an intermediate transferring member; 20 represents a black developing unit; 30 represents a cyan developing unit; 40 represents a magenta developing unit; 50 represents a yellow developing unit; 60*a* to 60*d* represent a primary transferring units (transferring rollers); 61, 62, 63 and 64 represent rollers; 70 represents a secondary transferring unit (transferring roller); 71 represents a primary transfer voltage supplying unit; 72 represents a secondary transfer voltage supplying unit; 80 represents an flash fixing unit; 90 represents a cleaning unit; 100 represents an image forming device; and 200 represents a recording medium.

The image forming device 100 illustrated in FIG. 1 includes: the developing units 20, 30, 40 and 50 for the respective colors, each of which developing units has the charging unit, the light-exposing unit, the photoreceptor, and the developing unit; the intermediate transferring member 10; the rolls 61, 62, 63 and 64, which are brought into contact with the internal circumferential surface of the intermediate transferring member 10 and around which the member 10 is wound in a tension state; the transferring rolls 60*a*, 60*b*, 60*c* and 60*d*, which are brought into contact with the internal circumferential surface of the intermediate transferring member to press the photoreceptors of the respective developing units through the intermediate transferring member 10; the primary transfer voltage supplying unit 71 for supplying voltage to the four transferring rolls 60*a*, 60*b*, 60*c* and 60*d*; the transferring roll 70, which is opposite the transferring roll 64 to put the intermediate transferring member 10 therebetween and to press the transferring roll 64 through the intermediate transferring member 10; the secondary transfer voltage supplying unit 72 for supplying voltage to the transferring roll 70; the cleaning unit 90 for cleaning the external circumferential surface of the intermediate transferring member 10; and the flash fixing device 80 for radiating light onto the recording medium 200 which is passing through a nip portion between the intermediate transferring member 10 and the transferring roll 70 in the direction shown by an arrow from the side of the recording medium 200 which side is brought into contact with the intermediate transferring member 10.

The black developing unit 20 has a structure in which the charging unit 1*a*, the light-exposing unit 2*a*, and the developing unit 4*a* are clockwise arranged around the photoreceptor 3*a*. The transferring roll 60*a* is arranged opposite a portion of the photoreceptor 3*a* which portion is disposed between the developing unit 4 and the charging unit 1*a* and which does not face the light-exposing unit 2, and the intermediate transferring member 10 is put between the transferring roll 60*a* and the photoreceptor 3*a*. The same structure is applied to each of the developing units for the other colors. In the image forming device of the invention, the developer including the yellow toner of the invention is contained in the developing unit 4*d* of the yellow developing unit 50. In the developing units of the other developing units, toners for flash fixation having the corresponding color are contained, respectively.

The black developing unit 20, the cyan developing unit 30, the magenta developing unit 40, the yellow developing unit 50, the cleaning unit 90 (a releasing blade thereof), and the transferring roll 70 are clockwise arranged in this order around and brought into contact with the external circumferential surface of the intermediate transferring member 10. The transferring rolls 60*a*, 60*b*, 60*c* and 60*d*, the cleaning unit 90 (a roll of the unit 90), and rolls 64, 63, 62 and 61 are clockwise arranged around the internal circumferential surface of the intermediate transferring member 10.

The following describes formation of an image by using the image forming device 100. In the black developing unit 20, first, the surface of the photoreceptor 3*a* is uniformly charged by the charging unit 1*a* while the photoreceptor 3*a* is being clockwise rotated. Next, the charged surface of the photoreceptor 3*a* is imagewise exposed to light from the light-exposing unit 2*a*, thereby forming, on the surface of the photoreceptor 3*a*, a latent image corresponding to the black color component image of an original image to be copied. Furthermore, a black toner contained in the developing unit 4 is given to this latent image, thereby developing the latent image to form a black toner image. A process similar to this process is performed in each of the cyan developing unit 30, the magenta developing unit 40 and the yellow developing unit 50, thereby forming a color toner image on the surface of the photoreceptor of each of the developing units.

The toner images having the respective colors, which are formed on the photoreceptor surfaces, are separately and successively transferred onto the intermediate transferring member 10, which rotates counterclockwise, due to action of transferring potential of each of the transferring rolls 60*a* to 60*d*. Thereby, the toner images are piled on the external circumferential surface of the intermediate transferring member 10, so that the resultant image corresponds to the original image. In this way, a full-color laminated toner image is formed.

Next, this laminated toner image on the intermediate transferring member 10 is conveyed to the nip portion between the roll 64 and the transferring roll 70. At this nip portion, the toner image is transferred onto the recording medium 200 due to action of transferring potential of the transferring roll 70. The laminated toner image that is transferred onto the recording medium 200 is conveyed to the flash fixing device 80. At this position, the toner image is exposed to light from the flash fixing device 80 and melts, and thereby the full color image is flash fixed on the recording medium 200.

After the end of transfer of the laminated toner image onto the recording medium 200, the toners remaining on the intermediate transferring member 10 are removed by the cleaning unit 90, which has the releasing blade that is, for example, a cleaning blade.

EXAMPLES (1) Production of Yellow Toners

A Henschel mixer is charged with toner starting materials which are a binder (binder resin), an antistatic agent, a wax, one or more yellow colorants, and one or more infrared absorbents shown in Table 1 or 2. The mixed components are preliminarily mixed, and then kneaded with an extruder. Next, the mixture is roughly pulverized with a hammer mill, and then pulverized into fine particles with a jet mill. An air-flow classifier is used to classify the fine particles. Then, colored fine particles having a volume average diameter of 8.5 μm are obtained. Next, 1.5 parts by weight of hydrophobic silica fine particles (trade name: R974, manufactured by Nippon Aerosil Co., Ltd.) and 0.5 part by weight of titanium oxide (trade name: NKT90, manufactured by Nippon Aerosil Co., Ltd.) are externally added to 100 parts by weight of the colored fine particles with a Henschel mixer, so as to yield a yellow toner of each of Examples and Comparative Examples.

L*, a* and b* of the yellow colorants used to produce the yellow toners are shown in Table 3. L*, a* and b* of the infrared absorbents and the colorants are measured as follows.

First, 40 g of tetrahydrofuran, 9.5 g of a polyester resin (FP118L, manufactured by Kao Corp.) and 0.5 g of the infrared absorbent or the yellow colorant are mixed, and then the absorbent or the colorant is dissolved or dispersed with a paint shaker for one hour to prepare a toner solution. A bar coater (No. 16) is used to apply the resultant toner solution onto white paper (reflectivity: 80±1) prescribed in JIS K5101. The resultant is dried to prepare a sample. Next, L*, a* and b* of the infrared absorbent or the yellow colorant is measured with a spectrometer (938 Spectrodentitometer, manufactured by X-Rite Incorporated.) from the surface of this sample onto which the absorbent or the colorant has been applied.

The light absorption peak (the wavelength of the maximum absorption peak in the wavelength range of infrared rays: λmax) of each of infrared absorbents used to produce color toners is shown in Table 4.

A magenta toner and a cyan toner, which are used together with the yellow toner, are made of toner starting materials shown in Table 5 and L*, a* and b* of each of the colorants thereof are obtained in the same manner as the preparation and measurement of the yellow toners described above.

(2) Evaluation Device and Evaluation Method

Figure 2:
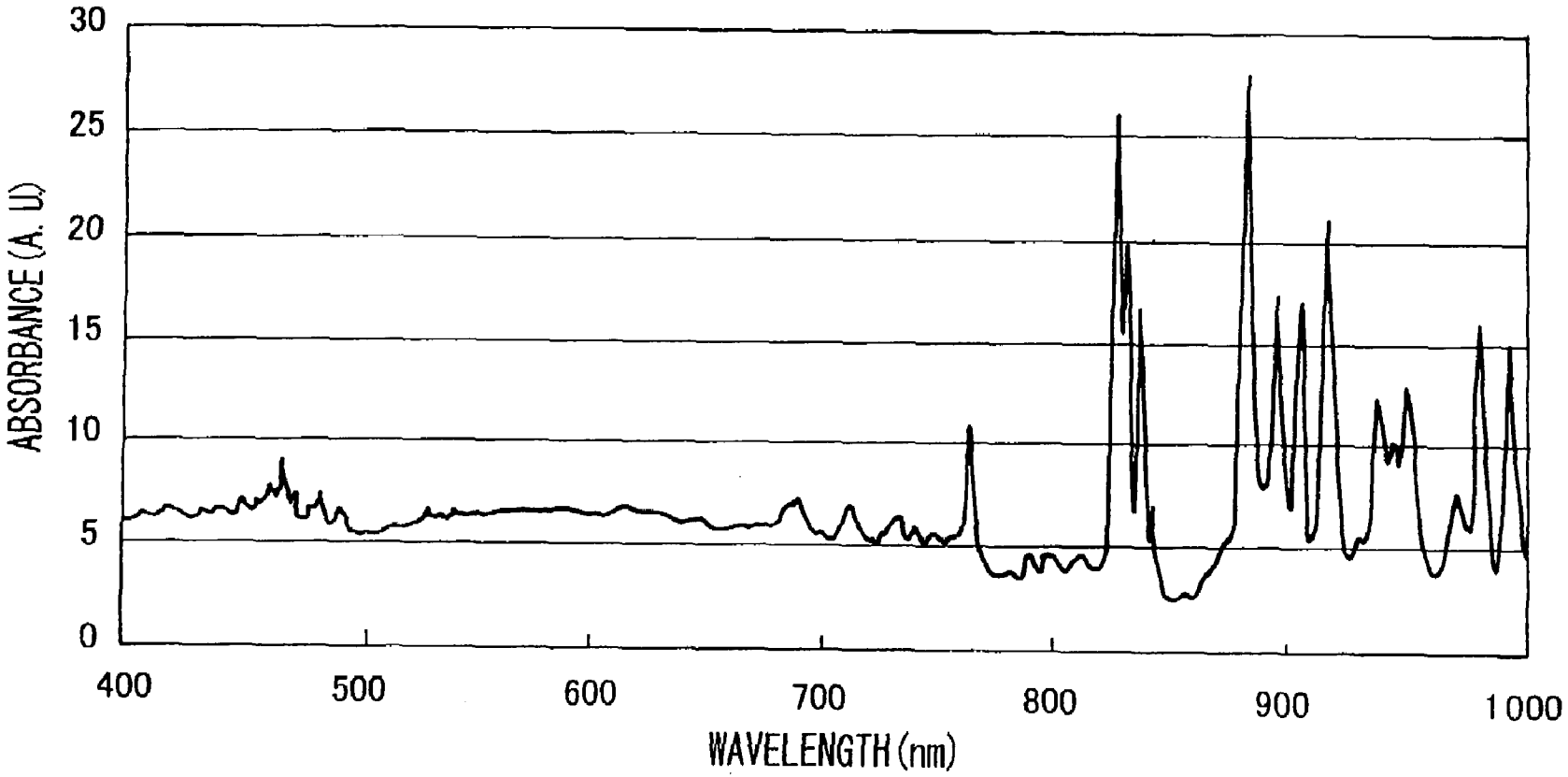
FIG. 2 is a graph showing the waveform of luminescence of a flash lamp.

An image forming device having a structure illustrated in FIG. 1 (a remodeled device wherein the flash fixing unit of a flash printer PS2160 (manufactured by Fujitsu Ltd.) is mounted on a printer GL8300 (manufactured by Fujitsu Ltd.)) is used as an evaluation device. For reference, the waveform of luminescence of the flash lamp of the flash fixing unit in this image forming device is shown in FIG. 2, which is a graph showing the waveform. Its transverse axis represents wavelength (nm), and the vertical axis represents absorbance (a. u.). As can be understood from FIG. 2, intense luminescence is present in the range of near infrared ray wavelengths of 750 nm or more. The flash energy at the time of image formation is set to 3.2 J/cm$^2$.

For evaluation, a yellow solid image made of only each of the yellow toners of Examples and Comparative Examples is formed on plain paper (NIP1500LT, manufactured by Kobayashi Kirokushi Co., Ltd.) such that the amount of the yellow toner adhering onto the paper is 0.5 g/cm$^2$. At this time, flash fixability, measured values of color reproducibility (L*, a* and b*) and color reproducibility are evaluated, respectively. The results are shown in Tables 1 and 2. An image is similarly made of each of the magenta toner (FCM-1) and the cyan toner (FCC-1), and flash fixability thereof is similarly evaluated.

Figure 3:
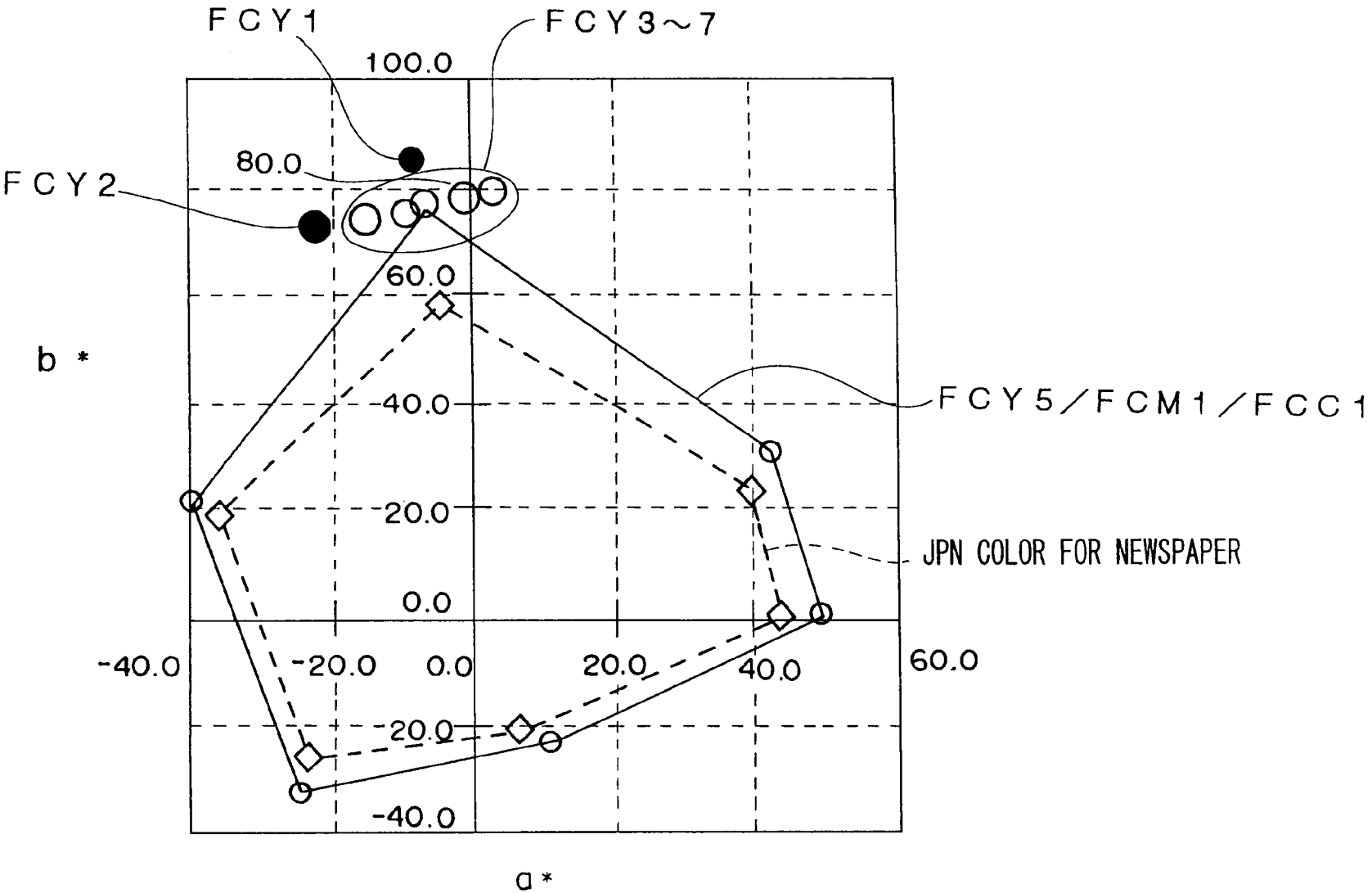
FIG. 3 is a graph showing color reproducibility of images obtained from color for newspaper JPN, and a combination of a yellow toner (FCY-5), a magenta toner (FCM-1) and a cyan toner (FCC-1) of Example 3, and color reproducibility of images obtained using yellow toners (FCY-1 to FCY-7) of Examples 1 to 5 and Comparative Examples 1 to 3, wherein a* of the images is represented by the transverse axis and b* thereof is represented by the vertical axis.

FIG. 3 is a graph showing color reproducibility of images obtained from color for newspaper JPN, and a combination of the yellow toner (FCY-5), the magenta toner (FCM-1) and the cyan toner (FCC-1) of Example 3, and color reproducibility of images made of yellow toners (FCY-1 to FCY-7) of Examples 1 to 5 and Comparative Examples 1 to 3, wherein a* of each image is represented by the transverse axis and b* thereof is represented by the vertical axis.

The following describes methods for evaluating flash fixability, measured values of color reproducibility (L*, a* and b*) and color reproducibility, and evaluation standards shown in Tables 1, 2 and 5.

-Methods for Evaluating Flash Fixability and Evaluation Standard Thereof-

Flash fixability is evaluated as follows. First, the spectrometer (938 Spectrodentitometer, manufactured by X-Rite Incorporated.) is used to measure the status A density of a toner image fixed on plain paper. Next, a peelable tape (trade name: "Scotch Mending Tape", manufactured by Sumitomo 3M Ltd.) is stuck onto the toner image on the plain paper. Thereafter, the peelable tape is peeled from the toner image and subsequently the status density of the image on the plain paper is measured. Given that the density of the printed image on the plain paper before the sticking is regarded as 100, the relative density of the printed image on the plain paper after the peeling is represented in percentage. This is defined as a toner fixation rate (flash fixability).

The evaluation standard for flash fixability shown in Tables 1, 2 and 5 is as follows. A toner fixation rate of 80% or more is at a practical level.

◎: A toner fixation rate of 90% or more

○: A toner fixation rate of not less than 80% and less than 90%

Δ: A toner fixation rate of not less than 70% and less than 80%

X: A toner fixation rate of less than 70%

-Measured Values of Color Reproducibility (L*, a* and b*)-

L*, a* and b* shown in Tables 1, 2 and 5 are measured with the spectrometer (938 Spectrodentitometer, manufactured by X-Rite Incorporated.) in a state where the printed matter on which the image is formed as described above is disposed on a white sheet.

-Color Reproducibility-

Color reproducibility shown in Tables 1 and 2 is evaluated on the basis of the measured values of color reproducibility (L*, a* and b*) and the following standard.

◎: L*=70 or more, a*=−5 to −9, and b*=70 or more

○: L*=70 or more, a*=−5 to 5 or −9 to −15, and b*=70 or more

X: At least one of L*, A* or b* is outside the range specified above.

(3) Evaluation Results

Comparative Example 1

Toner FCY-1, which contains no infrared absorbent, is good in color reproducibility. However, the toner cannot be fixed by flash fixation. The fixation rate thereof is 30% or less.

Comparative Example 2

The toner, in which 0.9% by weight of the infrared absorbent A is included in the toner FCY-1, exhibits sufficient fixability. However, the toner does not contain any yellow pigment (having an a* value of more than 0) selected from the group B, but contains a yellow pigment (having an a* value of less than 0) selected from the group A. Consequently, the color tone of the toner is greenish.

Examples 1 to 5

The toners, which includes a yellow pigment (having an a* value of more than 0) selected from the group B, are good in fixability and color reproducibility when compared with the toner FCY-2 of Comparative Example 2.

Comparative Examples 3 and 4, and Examples 6 and 7

When Toners FCY-8 to 11 are compared with each other, toners FCY-8 and 9 are good in color reproducibility. However, toners FCY-8 and 9 contain no infrared absorbent and therefore are poor in fixability. By inclusion of an infrared absorbent and 1% by weight of pigment 4 selected from the group B, toners FCY-10 and 11 have good color and fixability.

Example 8

The toner, in which the infrared absorbent in toner FCY-5 of Example 3 is changed from AM1 to YKR 5010, is good in fixability and color tone.

Example 9

The toner, in which pigment 4 in toner FCY-5 of Example 3 is changed to pigment 5 (having an a* value of more than 0) selected from the group B, is good in fixability and color tone.

Example 10

In the toner of Example 10, in which the infrared absorbent in toner FCY-4 of Example 2 is changed to a combination of infrared absorbents A and B and in which the added amount of the infrared absorbent(s) is changed from 0.9 to 0.6% by weight, both of fixability and color reproducibility can be remarkably improved and costs can be reduced.

Example 11

The toner of Example 11, in which only pigment 5 selected from the group B is used as the yellow colorant thereof, is good in fixability and color tone.

Example 12

The toner of Example 12, in which pigment 1 in Example 3 is changed to pigment 4, is good in fixability and color tone.

Examples 13 to 16

The toners of Examples 13 to 16, in which pigment 5 in Example 3 is changed to pigments 7 to 10, respectively, are good in fixability and color tone.

Example 17

The toner of Example 17, in which pigment 4 having an a* value of less than 0 is combined with the infrared absorbent C having an a* value of more than 0, is good in fixability and color tone.

Examples 18 and 19

The toners of Examples 18 and 19, in which pigment 4 used in Example 4 is used together with pigment 10, are good in fixability and color tone.

Comparative Example 5

The toner of Comparative Example 5, in which no pigment (having an a* value of less than 0) selected from the group B' is used as the yellow colorant thereof, is insufficient in color reproducibility.

Example 20

The toner of Example 20, in which infrared absorbent C in Example 19 is changed to infrared absorbent D, is good in fixability and color tone.

Example 21

The toner of Example 21, in which pigment 4 in Example 18 is changed to pigment 11, is good in fixability and color tone.

Example 22

The toner of Example 22, in which pigment 4 in Example 18 is changed to pigment 12, is good in fixability and color tone.

As shown in FIG. 3, L*, a* and b* of the flash-fixed printed matter wherein the three toners (toners FCY-5, FCM-1 and FCC-1) are combined are compared with those of Japan color for newspaper, respectively. As a result, it is proved that the color gamut of colors of the printed images, including secondary colors of RBG, is sufficient. It is also understood that fixability thereof is satisfactory.

TABLE 1

| | | Toner components (% by weight) | | | | | | | | | |
|---|---|---|---|---|---|---|---|---|---|---|---|
| | | | Anti-static | | Yellow colorants | | | | | | |
| | | Binder | agent | Wax | Pigment group A | | | | Pigment group B | | |
| | Toner | FN119 | PSY | 550P | Pigment 1 | Pigment 2 | Pigment 3 | Pigment 4 | Pigment 5 | Pigment 6 | Pigment 7 |
| Japan color for newspaper | | | | | | | | | | | |
| Comparative Example 1 | FCY-1 | 91.0 | 1 | 3 | 5 | 0 | 0 | 0 | 0 | 0 | 0 |
| Comparative Example 2 | FCY-2 | 90.1 | 1 | 3 | 5 | 0 | 0 | 0 | 0 | 0 | 0 |
| Example 1 | FCY-3 | 89.9 | 1 | 3 | 5 | 0 | 0 | 0 | 0.25 | 0 | 0 |
| Example 2 | FCY-4 | 89.6 | 1 | 3 | 5 | 0 | 0 | 0 | 0.5 | 0 | 0 |
| Example 3 | FCY-5 | 89.1 | 1 | 3 | 5 | 0 | 0 | 0 | 1 | 0 | 0 |
| Example 4 | FCY-6 | 88.1 | 1 | 3 | 5 | 0 | 0 | 0 | 2 | 0 | 0 |
| Example 5 | FCY-7 | 87.6 | 1 | 3 | 5 | 0 | 0 | 0 | 2.5 | 0 | 0 |
| Comparative Example 3 | FCY-8 | 91.0 | 1 | 3 | 0 | 5 | 0 | 0 | 0 | 0 | 0 |
| Comparative Example 4 | FCY-9 | 91.0 | 1 | 3 | 0 | 0 | 5 | 0 | 0 | 0 | 0 |
| Example 6 | FCY-10 | 89.1 | 1 | 3 | 0 | 5 | 0 | 0 | 1 | 0 | 0 |

TABLE 1-continued

| | | | | | | | | | | | |
|---|---|---|---|---|---|---|---|---|---|---|---|
| Example 7 | FCY-11 | 89.1 | 1 | 3 | 0 | 0 | 5 | 0 | 1 | 0 | 0 |
| Example 8 | FCY-12 | 89.1 | 1 | 3 | 5 | 0 | 0 | 0 | 1 | 0 | 0 |
| Example 9 | FCY-13 | 89.1 | 1 | 3 | 5 | 0 | 0 | 0 | 0 | 1 | 0 |
| Example 10 | FCY-14 | 89.9 | 1 | 3 | 5 | 0 | 0 | 0 | 0.5 | 0 | 0 |
| Example 11 | FCY-15 | 90.4 | 1 | 3 | 0 | 0 | 0 | 0 | 5 | 0 | 0 |
| Example 12 | FCY-16 | 94.1 | 1 | 3 | 0 | 0 | 0 | 5 | 1 | 0 | 0 |
| Example 13 | FCY-17 | 90.1 | 1 | 3 | 5 | 0 | 0 | 0 | 0 | 0 | 1 |
| Example 14 | FCY-18 | 90.1 | 1 | 3 | 5 | 0 | 0 | 0 | 0 | 0 | 0 |
| Example 15 | FCY-19 | 90.1 | 1 | 3 | 5 | 0 | 0 | 0 | 0 | 0 | 0 |
| Example 16 | FCY-20 | 90.1 | 1 | 3 | 5 | 0 | 0 | 0 | 0 | 0 | 0 |

| | Toner components (% by weight) | | | | | | Evaluation results | | | | |
|---|---|---|---|---|---|---|---|---|---|---|---|
| | Yellow colorants Pigment group B | | | Green-colored type infrared absorbent | | | Measured values of color reproducibility | | | | |
| | | | Pigment | | | | L* | a* | b* | | |
| | Pigment 8 | Pigment 9 | 10 | A | B | IRg/YB | 70 or more | −15 to 5 | 70 or more | Fixability | Color reproducibility |
| Japan color for newspaper | | | | | | | 77 | −4 | 58 | — | — |
| Comparative Example 1 | 0 | 0 | 0 | 0 | 0 | — | 80.2 | −6.2 | 85.0 | X | ○ |
| Comparative Example 2 | 0 | 0 | 0 | 0.9 | 0 | More than 4 | 77.9 | −21.5 | 72.2 | ○ | X |
| Example 1 | 0 | 0 | 0 | 0.9 | 0 | 3.6 | 76.8 | −14.5 | 73.2 | ○ | ○ |
| Example 2 | 0 | 0 | 0 | 0.9 | 0 | 1.8 | 76.4 | −8.5 | 74.6 | ○ | ◎ |
| Example 3 | 0 | 0 | 0 | 0.9 | 0 | 0.9 | 75.5 | −5.8 | 76.3 | ○ | ◎ |
| Example 4 | 0 | 0 | 0 | 0.9 | 0 | 0.45 | 75.2 | −0.8 | 77.6 | ○ | ○ |
| Example 5 | 0 | 0 | 0 | 0.9 | 0 | 0.36 | 74.5 | 3.6 | 78.6 | ○ | ○ |
| Comparative Example 3 | 0 | 0 | 0 | 0 | 0 | — | 79.5 | −5.2 | 84.0 | X | ◎ |
| Comparative Example 4 | 0 | 0 | 0 | 0 | 0 | — | 78.9 | −5.0 | 83.5 | X | ◎ |
| Example 6 | 0 | 0 | 0 | 0.9 | 0 | 0.9 | 75.5 | −4.7 | 75.4 | ○ | ○ |
| Example 7 | 0 | 0 | 0 | 0.9 | 0 | 0.9 | 74.4 | −6.1 | 75.6 | ○ | ◎ |
| Example 8 | 0 | 0 | 0 | 0 | 0.9 | 0.9 | 76.2 | −4.9 | 75.5 | ○ | ○ |
| Example 9 | 0 | 0 | 0 | 0.9 | 0 | 0.9 | 75.0 | −4.8 | 76.0 | ○ | ○ |
| Example 10 | 0 | 0 | 0 | 0.3 | 0.3 | 1.2 | 79.2 | −4.6 | 81.2 | ◎ | ○ |
| Example 11 | 0 | 0 | 0 | 0.3 | 0.3 | 0.12 | 79.2 | −0.5 | 82.6 | ◎ | ○ |
| Example 12 | 0 | 0 | 0 | 0.9 | 0 | 0.9 | 74.3 | −4.5 | 78.2 | ○ | ○ |
| Example 13 | 0 | 0 | 0 | 0.9 | 0 | 0.9 | 73.5 | −2.5 | 76.5 | ○ | ○ |
| Example 14 | 1 | 0 | 0 | 0.9 | 0 | 0.9 | 73.6 | −2.6 | 77.6 | ○ | ○ |
| Example 15 | 0 | 1 | 0 | 0.9 | 0 | 0.9 | 72.9 | −2.3 | 72.6 | ○ | ○ |
| Example 16 | 0 | 0 | 1 | 0.9 | 0 | 0.9 | 73.9 | −5.2 | 77.3 | ○ | ◎ |

FN119: Polyester binder (Kao Corp.)

PSY: Quaternary ammonium salt (Clariant Co.)

550P: Polypropylene (Sanyo Chemical Industries, Ltd.)

Pigment 1: Pigment Yellow 180, Trade name: Toner Yellow HG (Clariant Co.)

Pigment 2: Pigment Yellow 185, Trade name: Paliotol Yellow D1155 (BASF)

Pigment 3: Pigment Yellow 74, Trade name: Hansa Brilliant Yellow 2GX70N (Clariant Co.)

Pigment 4: Pigment Yellow 93, Trade name: Yellow No. 40 (Dainichiseika Color & Chemicals Mfg. Co., Ltd.)

Pigment 5: Pigment Yellow 139, Trade name: Novoperm Yellow P-M3R (Clariant Co.)

Pigment 6: Pigment Yellow 110, Trade name: Cromophtal Yellow 2RLP (Ciba Geigy)

Pigment 7: Pigment Yellow 95, Trade name: Chromo Fine Yellow 5900 (Dainichiseika Color & Chemicals Mfg. Co., Ltd.)

Pigment 8: Pigment Yellow 123, Trade name: Chromo Fine Yellow AF110A (Dainichiseika Color & Chemicals Mfg. Co., Ltd.)

Pigment 9: Pigment Yellow 166 Trade name: Chromo Fine Yellow 5910 (Dainichiseika Color & Chemicals Mfg. Co., Ltd.)

Pigment 10: Pigment Yellow 193, Trade name: Chromo Fine Yellow AF1300 (Dainichiseika Color & Chemicals Mfg. Co., Ltd.)

Infrared absorbent A: Onium compound AM1 (Teikoku Chemical Industries Co., Ltd.)

Infrared absorbent B: Naphthalocyanine YKR5011 (Yamamoto Chemicals, Inc.)

TABLE 2

| | | Toner components (% by weight) | | | | | | | | | | | | | | |
|---|---|---|---|---|---|---|---|---|---|---|---|---|---|---|---|---|
| | | | | | Yellow colorants | | | | | | | Evaluation results | | | | |
| | | | | | Pigment group A' | Pigment group B' | | | Green-colored type | | | Measured values of color reproducibility | | | | Color |
| | Toner | Binder FN119 | Anti-static agent PSY | Wax 550P | Pigment 10 | Pigment 4 | Pigment 11 | Pigment 12 | infrared absorbent C | infrared absorbent D | IRg/YB' | L* 70 or more | a* −15 to 5 | b* 70 or more | Fixability | reproducibility |
| Example 17 | FCY-21 | 90.0 | 1 | 3 | 0 | 5 | 0 | 0 | 1 | 0 | 0.2 | 75.2 | −14.2 | 75.0 | ○ | ○ |
| Example 18 | FCY-22 | 85.0 | 1 | 3 | 1 | 9 | 0 | 0 | 1 | 0 | 0.1 | 76.5 | −4.5 | 72.2 | ○ | ○ |
| Example 19 | FCY-23 | 90.8 | 1 | 3 | 4 | 0.25 | 0 | 0 | 1 | 0 | 4 | 72.2 | 4.8 | 73.2 | ○ | ○ |
| Comparative Example 5 | FCY-24 | 90.0 | 1 | 3 | 5 | 0 | 0 | 0 | 1 | 0 | — | 72.9 | 10.2 | 74.6 | ○ | X |
| Example 20 | FCY-25 | 90.8 | 1 | 3 | 4 | 0.25 | 0 | 0 | 0 | 1 | 4 | 73.2 | 4.3 | 73.6 | ○ | ○ |
| Example 21 | FCY-26 | 85.0 | 1 | 3 | 1 | 0 | 9 | 0 | 1 | 0 | 0.1 | 75.5 | −3.5 | 71.2 | ○ | ○ |
| Example 22 | FCY-27 | 85.0 | 1 | 3 | 1 | 0 | 0 | 9 | 1 | 0 | 0.1 | 76.5 | −5 | 72 | ○ | ○ |

FN119: Polyester binder (Kao Corp.)
PSY: Quaternary ammonium salt (Clariant Co.)
550P: Polypropylene (Sanyo Chemical Industries, Ltd.)
Pigment 4: Pigment Yellow 93, Trade name: Toner Yellow (Dainichiseika Color & Chemicals Mfg. Co., Ltd.)
Pigment 10: Pigment Yellow 193, Trade name: Toner Yellow (Dainichiseika Color & Chemicals Mfg. Co., Ltd.)
Pigment 11: Pigment Yellow 138, Trade name: ECY-297 (Dainichiseika Color & Chemicals Mfg. Co., Ltd.)
Pigment 12: Pigment Yellow 167, Trade name: A-3 Yellow (Dainichiseika Color & Chemicals Mfg. Co., Ltd.)
Infrared absorbent C: Nickel complex SIR130 (Mitsui Chemicals, Inc.)
Infrared absorbent B: NIA770H (Hakkol Chemical Co.)

TABLE 3

| | | Measured values of color reproducibility | | |
|---|---|---|---|---|
| Yellow colorant | Trade name | L* | a* | b* |
| Pigment 1: Pigment Yellow 180 | Toner Yellow HG (Clariant Co.) | 84.8 | −1.5 | 87.8 |
| Pigment 2: Pigment Yellow 185 | Paliotol Yellow D1155 (BASF) | 86.3 | −3.6 | 84.6 |
| Pigment 3: Pigment Yellow 74 | Hansa Brilliant Yellow 2GX70N (Clariant Co.) | 85.3 | −2.6 | 83.4 |
| Pigment 4: Pigment Yellow 93 | Yellow No. 40 (Dainichiseika Color & Chemicals Mfg. Co., Ltd.) | 86.3 | −8.8 | 95.3 |
| Pigment 5: Pigment Yellow 139 | Novoperm Yellow P-M3R (Clariant Co.) | 89.9 | 14.0 | 77.8 |
| Pigment 6: Pigment Yellow 110 | Cromophtal Yellow 2RLP (Ciba Geigy) | 88.6 | 6.8 | 88.6 |
| Pigment 7: Pigment Yellow 95 | Chromo Fine Yellow 5900 (Dainichiseika Color & Chemicals Mfg. Co., Ltd.) | 86.4 | 10.6 | 88.6 |
| Pigment 8: Pigment Yellow 123 | Chromo Fine Yellow AF110A (Dainichiseika Color & Chemicals Mfg. Co., Ltd.) | 86.3 | 10.3 | 86.3 |
| Pigment 9: Pigment Yellow 166 | Chromo Fine Yellow 5910 (Dainichiseika Color & Chemicals Mfg. Co., Ltd.) | 82.3 | 11.2 | 82.6 |

TABLE 3-continued

| Yellow colorant | Trade name | Measured values of color reproducibility L* | a* | b* |
|---|---|---|---|---|
| Pigment 10: Pigment Yellow 193 | Chromo Fine Yellow AF1300 (Dainichiseika Color & Chemicals Mfg. Co., Ltd.) | 82.6 | 8.6 | 86.3 |
| Pigment 11: Pigment Yellow 138 | ECY-297 (Dainichiseika Color & Chemicals Mfg. Co., Ltd.) | 86.3 | −11.2 | 75.6 |
| Pigment 12: Pigment Yellow 167 | A-3 Yellow (Dainichiseika Color & Chemicals Mfg. Co., Ltd.) | 84.3 | −10.5 | 79.6 |

TABLE 4

| Infrared absorbent | Trade name | Measured values of color reproducibility L* | a* | b* | λmax (nm) |
|---|---|---|---|---|---|
| Infrared absorbent A (onium compound) | AM1 (Teikoku Chemical Industries Co., Ltd.) | 25.0 | −15.3 | 1.2 | 1250 |
| Infrared absorbent B (naphthalocyanine) | YRK5011 (Yamamoto Chemicals, Inc.) | 31.0 | −18.3 | 2.5 | 880 |
| Infrared absorbent C (nickel complex) | SIR 30 (Mitsui Chemicals, Inc.) | 26.0 | 12.6 | 13.8 | 855 |
| Infrared absorbent D (polyazo compound) | NIA770H (Hakkol Chemical Co.) | 29.0 | 16.5 | 13.8 | 770 |

TABLE 5

| | | Toner components (% by weight) | | | | | | | Evaluation results | | | |
|---|---|---|---|---|---|---|---|---|---|---|---|---|
| | | | Antistatic | | Pigments | | Infrared | | Measured values of | | | |
| | | Binder | agent | Wax | Magenta | Cyan | absorbent | | color reproducibility | | | |
| | Toner | FN119 | PSY | 550P | pigment | pigment | A | B | L* | a* | B* | Fixability |
| Magenta toner | FCM-1 | 90.0 | 1 | 3 | 5 | 0 | 1 | 0 | 43.4 | 50.3 | −0.2 | ○ |
| Cyan toner | FCC-1 | 93.0 | 1 | 3 | 0 | 2 | 1 | 0 | 51.9 | −23.9 | −32.6 | ○ |

Magnet pigment (Pigment Violet 19, trade name: Hostaperm Red E2B70 (Clariant Co.)
Cyan pigment (Pigment Blue 15, trade name: BLUE BLPO (Ciba Geigy))

What is claimed is:

1. A yellow toner for flash fixation, comprising an infrared absorbent, one or more yellow colorants, and a binder resin, wherein a* of the infrared absorbent in a CIELAB color space is less than 0, and a* of one yellow colorant in the CIELAB color space is more than 0; and wherein the yellow colorants comprise one or more yellow colorants selected from the group A consisting of C. I. Pigment Yellow 180, C. I. Pigment Yellow 185, C. I. Pigment Yellow 74, and C. I. Pigment Yellow 93, and one or more yellow colorants selected from the group B consisting of C. I. Pigment Yellow 139, C. I. Pigment Yellow 110, C. I. Pigment Yellow 95, C. I. Pigment Yellow 123, C. I. Pigment Yellow 166 and C. I. Pigment Yellow 193.

2. A yellow toner for flash fixation according to claim 1, wherein the yellow colorants comprise a first yellow colorant, a* of which in the CIELAB color space is 5 or more, and a second yellow colorant, a* of which is within a range of 0 to -10.

3. A yellow toner for flash fixation according to claim 1, wherein the ratio by weight of the amount of the infrared absorbent to the amount of the one or more yellow color colorants selected from the group B ranges from 0.1 to 4.

4. A yellow toner for flash fixation according to claim 1, wherein the infrared absorbent is at least one selected from the group consisting of onium compounds, cyanine compounds, phthalocyanine compounds, and ytterbium compounds.

5. A yellow toner for flash fixation according to claim 4, which comprises one or more of the onium compounds and one or more of the phthalocyanine compounds.

6. A yellow toner for flash fixation according to claim 1, L* of which is 70 or more, a* of which is from −15 to 5, and b* of which is 70 or more, L*, a* and b* being values in the CIELAB color space of a yellow solid image formed on a surface of a recording medium so as to set the amount of the yellow toner adhering to the surface to 0.5 $mg/cm_2$ or more by electrophotography using only a developer containing the yellow toner.

7. An electrophotographic developer, comprising a yellow toner for flash fixation comprising an infrared absorbent, one or more yellow colorants, and a binder resin, wherein a* of the infrared absorbent in a CIELAB color space is less than 0, and a* of one or more of the yellow colorants in the CIELAB color space is more than 0; and wherein the yellow colorants comprise one or more yellow colorants selected from the group A consisting of C. I. Pigment Yellow 180, C. I. Pigment Yellow 185, C. I. Pigment Yellow 74, and C. I. Pigment Yellow 93, and one or more yellow colorants selected from the group B consisting of C. I. Pigment Yellow 139, C. I. Pigment Yellow 110, C. I. Pigment Yellow 95, C. I. Pigment Yellow 123, C. I. Pigment Yellow 166 and C. I. Pigment Yellow 193.

8. An image forming method comprising: forming an electrostatic latent image on a surface of a latent image holding member, developing the electrostatic latent image formed on the surface of the latent image holding member with a developer comprising a yellow toner for flash fixation comprising an infrared absorbent, one or more yellow colorants, and a binder resin to form a toner image, transferring the toner image formed on the surface of the latent image holding member onto a surface of an image recording medium, and flash fixing the toner image onto the surface of the recording medium to form an image, wherein a* of the infrared absorbent in a CIELAB color space is less than 0, and a* of one or more of the yellow colorants in the CIELAB color space is more than 0; and wherein the yellow colorants comprise one or more yellow colorants selected from the group A consisting of C. I. Pigment Yellow 180, C. I. Pigment Yellow 185, C. I. Pigment Yellow 74, and C. I. Pigment Yellow 93, and one or more yellow colorants selected from the group B consisting of C. I. Pigment Yellow 139, C. I. Pigment Yellow 110, C. I. Pigment Yellow 95, C. I. Pigment Yellow 123, C. I. Pigment Yellow 166 and C. I. Pigment Yellow 193.

9. A yellow toner for flash fixation, comprising an infrared absorbent, one or more yellow colorants, and a binder resin, wherein a* of the infrared absorbent in a CIELAB color space is more than 0, and a* of one or more of the yellow colorants in the CIELAB color space is less than 0; and wherein the yellow colorants comprise one or more yellow colorants selected from the group A' consisting of C. I. Pigment Yellow 95, C. I. Pigment Yellow 123, C. I. Pigment Yellow 166, and C. I. Pigment Yellow 193, and one or more yellow colorants selected from the group B' consisting of C. I. Pigment Yellow 93, C. I. Pigment Yellow 138 and C. I. Pigment Yellow 167.

10. A yellow toner for flash fixation according to claim 9, wherein the yellow colorants comprise a first yellow colorant, a* of which in the CIELAB color space is −5 or less, and a second yellow colorant, a* of which is within a range of 0 to 10.

11. A yellow toner for flash fixation according to claim 9 wherein the ratio by weight of the amount of the infrared absorbent to the amount of the one or more yellow color colorants selected from the group B' ranges from 0.1 to 4.

12. A yellow toner for flash fixation according to claim 9, wherein the infrared absorbent is at least one selected from the group consisting of nickel complex compounds, and polyazo compounds.

13. A yellow toner for flash fixation according to claim 9, L* of which is 70 or more, a* of which is from −15 to 5, and b* of which is 70 or more, L*, a* and b* being values in the CIELAB color space of a yellow solid image formed on a surface of a recording medium so as to set the amount of the yellow toner adhering to the surface to 0.5 $mg/cm_2$ or more by electrophotography using only a developer containing the yellow toner.

14. An electrophotographic developer, comprising a yellow toner for flash fixation comprising an infrared absorbent, one or more yellow colorants, and a binder resin, wherein a* of the infrared absorbent in a CIELAB color space is more than 0, and a* of one or more of the yellow colorants in the CIELAB color space is less than 0; and wherein the yellow colorants comprise one or more yellow colorants selected from the group A' consisting of C. I. Pigment Yellow 95, C. I. Pigment Yellow 123, C. I. Pigment Yellow 166, and C. I. Pigment Yellow 193, and one or more yellow colorants selected from the group B' consisting of C. I. Pigment Yellow 93, C. I. Pigment Yellow 138 and C. I. Pigment Yellow 167.

15. An electrophotographic developer according to claim 14, wherein the yellow colorants comprise a first yellow colorant, a* of which in the CIELAB color space is −5 or less, and a second yellow colorant, a* of which is within a range of 0 to 10.

16. An electrophotographic developer according to claim 14, wherein the ratio by weight of the amount of the infrared absorbent to the amount of the one or more yellow color colorants selected from the group B' ranges from 0.1 to 4.

17. An image forming method comprising: forming an electrostatic latent image on a surface of a latent image holding member, developing the electrostatic latent image formed on the surface of the latent image holding member with a developer comprising a yellow toner for flash fixation comprising an infrared absorbent, one or more yellow colorants, and a binder resin to form a toner image, transferring the toner image formed on the surface of the latent image holding member onto a surface of an image recording medium, and flash fixing the toner image onto the surface of the recording medium to form an image, wherein a* of the infrared absorbent in a CIELAB color space is more than 0, and a* of one or more of the yellow colorants in the CIELAB color space is less than 0; and wherein the yellow colorants comprise one or more yellow colorants selected from the group A' consisting of C. I. Pigment Yellow 95, C. I. Pigment Yellow 123, C. I. Pigment Yellow 166, and C. I. Pigment Yellow 193, and one or more yellow colorants selected from the group B' consisting of C. I. Pigment Yellow 93, C. I. Pigment Yellow 138 and C. I. Pigment Yellow 167.

* * * * *